US011607019B2

(12) United States Patent
Sáenz Lobsack

(10) Patent No.: US 11,607,019 B2
(45) Date of Patent: Mar. 21, 2023

(54) FOREHEAD BINDI-HOLDING DEVICE

(71) Applicant: TAURUM TECHNOLOGIES, S.L., Madrid (ES)

(72) Inventor: Daniel Sáenz Lobsack, Madrid (ES)

(73) Assignee: TAURUM TECHNOLOGIES SL, Madrid (ES)

( * ) Notice: Subject to any disclaimer, the term of this patent is extended or adjusted under 35 U.S.C. 154(b) by 0 days.

(21) Appl. No.: 17/639,919

(22) PCT Filed: Sep. 9, 2020

(86) PCT No.: PCT/EP2020/075181
§ 371 (c)(1),
(2) Date: Mar. 3, 2022

(87) PCT Pub. No.: WO2021/048196
PCT Pub. Date: Mar. 18, 2021

(65) Prior Publication Data

US 2022/0330667 A1 Oct. 20, 2022

(30) Foreign Application Priority Data

Sep. 10, 2019 (EP) ..... 19382784

(51) Int. Cl.
*A44C 15/00* (2006.01)
*A44C 17/02* (2006.01)
*A44C 25/00* (2006.01)

(52) U.S. Cl.
CPC ..... *A44C 15/003* (2013.01)

(58) Field of Classification Search
CPC ..... A44C 15/003; A44C 13/00; A44C 15/00; A44C 15/0025; A44C 15/006; A44C 25/001; A44C 17/0233; A44C 17/0225; A44C 17/0216; A44C 17/0208
See application file for complete search history.

(56) References Cited

U.S. PATENT DOCUMENTS

| | | | |
|---|---|---|---|
| 2008/0239232 A1 | 10/2008 | Guerrero | |
| 2015/0173468 A1 | 6/2015 | Stevenson | |
| 2018/0267337 A1 | 9/2018 | Walker | |

FOREIGN PATENT DOCUMENTS

| | | | | |
|---|---|---|---|---|
| AU | 2016101354 A4 | | 9/2016 | |
| CN | 204832698 U | | 12/2015 | |
| DE | 19835585 A1 | * | 2/2000 | ..... A44C 15/003 |
| FR | 2777165 A1 | | 10/1999 | |
| JP | S5516546 U | | 2/1980 | |
| JP | S616820 U | | 1/1986 | |
| JP | 10023906 A | * | 1/1998 | ..... A44C 15/003 |
| WO | 2004023921 A1 | | 3/2004 | |

* cited by examiner

*Primary Examiner* — Jack W Lavinder

(57) ABSTRACT

A forehead bindi-holding device for holding at least one bindi and configured to be arranged on a supporting object worn by a user, wherein when the user wears the supporting object with the forehead bindi-holding device, the at least one bindi is on a desired specific spot of a forehead of the user. The forehead bindi-holding device includes one or more cups, wherein each of the one or more cups supports, holds and contains each of the at least one bindi; a cups-holder to support the one or more cups; one stem element to support the cups-holder at an upper end of the stem element; an attachment unit for attaching a lower end of the stem element to the supporting object.

19 Claims, 5 Drawing Sheets

FOREHEAD BINDI-HOLDING DEVICE

CROSS REFERENCE TO THE RELATED APPLICATIONS

This application is the national stage entry of International Application No. PCT/EP2020/075181, filed on Sep. 9, 2020, which is based upon and claims priority to European Patent Application No. 19382784.7 filed on Sep. 10, 2019, the entire contents of which are incorporated herein by reference.

TECHNICAL FIELD

The present invention relates to a forehead bindi-holding device created to facilitate, improve and enrichen the experience of wearing bindis.

Bindis (from Sanskrit word 'bindu', meaning 'drop' or 'spot') are generally defined as simple small decorative marks or elements that many people (principally women from Meridional and Southeast Asia) carry on a precise horizontally-centered point of their foreheads (on the position of the so called 'third eye'). People wear bindis for different often-mixed reasons: to beautify themselves, to socially-identify themselves, or to try to positively influence themselves (or their surrounding environment) in aspects such as health, wellbeing, spirituality, intellectual capacity, physical performance, and luck.

A wide majority of users of bindis stick them directly on the approximate center of the skin of their foreheads via some kind of adhesive material. This system implies quite many inconveniencies, namely:

- noxiousness of materials used to adhere the bindi to the skin (e.g. causing dermatoses);
- risk of skin damage when the bindis (or their remains) are removed;
- uncomfortable cleaning of remnants of adhesive material from the skin after removing the bindi;
- high risk of displacement, deterioration, or loss (even unnoticed) of the bindi, when it is worn, put on or removed, or as a consequence of deficiencies in its fixation, especially with changes of ambient temperature or with the sweating of the user's forehead;
- significant risk of damage of the bindis after only one usage, circumstance that forces a majority of bindis to be disposable and of very low quality;
- bindis' enormous limitation in the variety of shapes (generally flat), of weights (generally minimal) and of economic/emotional value (generally negligible);
- difficulty in placing and maintaining the position of the bindis at a precise point of the forehead, a location that may vary with the physical characteristics and functions of the bindi and that depends greatly on the specific morphology of the body of the user (disposition and shape of eyes, nose, eyebrows, forehead) and the specific desires of the user;
- cumbersome repetitiveness of the daily efforts to accurately place and wear the bindis;
- involuntary variability of the exact positioning of the bindi due to lack of sufficient hand skills or other physical impairments;
- risk of inconvenient or unhealthy staining the hands with the materials of the bindi;
- impossibility or strong limitations to carry bindis that, due to their specific functions, must always be worn in real or apparent contact with the skin, or at an exact distance from it;

- impossibility or strong limitations to carry bindis that should be worn not facing the exterior of the forehead's skin ('external bindis') but oriented towards the inside of the body touching or almost-touching the forehead skin ('internal bindis');
- impossibility or considerable limitations to carry more than one bindi at a time, e.g. when the user desires to simultaneously wear a pair of bindis, one external and one internal.

BACKGROUND

In spite of the numerous limitations and inconveniences associated to the current ways of wearing bindis via adhesive materials, a convincing alternative system does not yet exist in the prior art, due to general old-habits inertia and to lack of sufficient popular ingenuity in trying to resolve regular mundane inconveniences.

A market research results in finding only a few possible alternative solutions to glue-sticking bindis:

- a known system placing one bindi fixedly attached and embedded within the framework of a pair of sunglasses,
- a known system placing one bindi fixedly attached and embedded within the framework of a diadem-like object worn on the top frame of the forehead or on the top of the head,
- known systems similar to the above-mentioned but presenting the bindi hanging from a small chain.

A patent prior-art search results in finding, not specific bindi-holding inventions, but some indirectly-related patents presenting mechanisms that allow attachment of decorative elements to eyewear, for example:

The Patent Application US 20082392 A1 discloses an interchangeable eyewear adornment-attachment accessory comprising a mounting member with the shape of a shallow cup allowing an aesthetic adornment to be temporarily attached to it, by means of a clip-type connection. The adornment disclosed in this document is attached to the glasses bridge, via the mentioned clip connection. However, no adornment of the bindi type could be attached to glasses using this configuration, such that the adornment could be placed on a user's forehead. Moreover, no correct orientation or placement of the adornment is described or hinted by the mentioned patent application, which remains silent in this respect. The problematic of wearing bindis correctly placed substantially in the middle of the user's forehead and also under a certain constant pressure ensuring no movement is not solved neither mentioned by this application, which remains silent in this regard.

For example, Japanese Utility Model JPS616820 U discloses an eyewear adornment, of the jewelry type, that is attached to the user's glasses by supporting means. These supporting means comprise a central element attaching the adornment to the glasses bridge and comprises two side elements joining the adornment to the glasses structure. In this way, the adornment is fixed to the glasses structure and remains in place. However, the eyewear adornment is not interchangeable, and is also intended to be put in place with respect to the glasses structure, that is, no placement of the adornment is intended by the present document with respect to the user's face, specifically the user's forehead. Once again, the problematic of supporting bindis correctly in place on/by a user's forehead with time is not mentioned by this document, which remains fully silent over this and provides no hint in this respect.

It is also known, for example, Chinese Utility Model CN 204832698 U, disclosing a mechanism that uses magnets to facilitate the anchoring of nose-pads to an eyewear central bridge. It also contemplates the possibility of adding decorative elements, that will be placed on the glasses bridge. As already mentioned for the previous documents of prior art, nothing in this document describes or hints towards placing any decoration on the forehead of a user, such as a bindi or the like. Moreover, placing these decorative objects such as bindis on/by the user's forehead over time, at a certain central position, would not be achieved by this document, neither would it be obvious to create a structure allowing this.

It is also known in the state of the art the Japanese Utility Model JPS5516546 U, disclosing a clipping mechanism to attach an adornment piece to an eyewear rim, typically to a glasses bridge. Once again, this document does not disclose any attachment structure allowing placing decorative elements on/by a user's forehead, such as bindis or the like.

The known Patent Application US 2018267337 A1 discloses a pair of eyeglasses with interchangeable parts to allow randomly changes in the lens, nose support and decorative parts of the frame. However, this document does not mention neither would allow placing a decorative object, such as a bindi or the like, on/by a user's forehead, neither at a certain positioning.

The document WO2004/0239245A1 discloses a band for ornament that can be attached to the face.

As can be noticed, the referred inventions have the object of allowing simple decorative customizations to eyewear, not of providing systems to facilitate and perfectly place one or more bindis in their exact central forehead positions, nor to customize, improve and enrichen the bindi-wearing experience, as it is the object of the present invention. No element or part of any of these documents could be based to obtain by combination the present invention, as it will be further described, and no part of the documents either hints to the problematic of correctly placing and wearing one or more bindis, as it is the object of the invention.

SUMMARY

In view of the foregoing prior art, an object of the present invention is to provide a device for holding forehead bindi-like objects, further enhancing the user's experience of wearing them.

The device object of the present invention allows the user many advantages, such as the ones described below:

- to place and wear one or more bindis, or auxiliary elements to them, for as long as wanted, on a specific spot of the center of the forehead;
- to carry, put on and take off bindis, in a quick and easy way, with nil or minimal risk of loss, damage and soiling of the bindis;
- to carry, put on and take off bindis without worrying about damages on the skin and without having to clean the skin from bindi-gluing remains;
- to significantly amplify the range of possible bindis to wear, extending it for example to all those bindis (such as jewels and curative gems) that do not present a flat form or that do not have an insignificant weight or that do have a much higher economical or emotional value than that of commonly used bindis;
- to voluntarily adjust the exact tridimensional position of bindis in relation to the forehead, this is, not only regarding vertical and horizontal dimensions on the surface of the forehead, but also regarding the precise distance separating a bindi from the forehead skin (distance that may be nil, apparently nil, or established in a concrete minimal distance), as well as regarding the orientation (degrees of inclination) of a bindi relative to the surface of the forehead skin;
- to carry, put on and take off bindis with nil or minimal risk of modifying or losing the configuration of their exact location and orientation on the forehead, which is very particular and specific to each user;
- to carry, put on and take off bindis without the need of touching the bindi with the hands;
- to wear interchangeable bindis (easily mountable and dismountable);
- to wear a bindi in direct contact and minimal continuous pressure with the forehead skin or at an exact distance from it;
- to wear external bindis that can fully or almost-fully hide a simultaneously-worn internal bindi;
- to adjust position of bindis via gradual incrementation systems;
- to be able to adjust the position and orientation of bindis relative to different inclinations of surfaces of potentially-bindi-holding supporting objects also worn on the user's head.

According to a first aspect, the invention relates to a forehead bindi-holding device BH for holding at least one bindi BI and configured to be arranged on a supporting object SO worn by a user US: when the user wears the supporting object SO with the forehead bindi-holding device BH, the at least one bindi BI is placed on or by the user's forehead. The forehead bindi-holding device BH of the invention comprises: one or more cups CU each of them supporting, holding and containing each of the one or more bindis BI; one cups-holder CH to support the one or more cups CU; one stem element ST to support the cups-holder CH at the upper end of the stem element ST, and one attachment unit AU for attaching the lower end of the stem element ST to the supporting object SO.

Preferably, the stem element ST in the forehead bindi-holding device BH of the invention comprises a plurality of consecutive segments, these segments being of longitudinal straight shape and/or of longitudinal curved shape.

Typically, in the forehead bindi-holding device BH according to the present invention, the attachment unit AU is fixed, not leaving any substantial degree of movement between the lower portion of the stem element ST and the supporting object SO.

In a preferred embodiment, at least one of the segments of the stem element ST is made out of a material sufficiently malleable to allow the stem element ST to modify its inclination relative to the supporting object SO and/or the position of the upper end of the stem element ST relative to the supporting object SO.

According to one possible embodiment, the attachment between the stem element ST and the supporting object SO is articulated, comprising a movable joint MJ to allow a degree of rotational movement of the stem element ST about its point of union with the supporting object SO.

Preferably, the attachment unit AU further comprises a forehead pressure-mechanism PM configured to exert a sufficient constant force to push the top end of the stem element ST towards the user's forehead.

The attachment unit AU can also further comprise an adjustment mechanism AM allowing to modify the degree of inclination of the stem element ST with respect to the supporting object SO.

According to another possible embodiment, the articulated attachment unit AU allows up to 180° of rotation of the stem element ST about the movable joint MJ and relative to the supporting object SO to facilitate folding of the bindi-holding device into/with the supporting object SO.

In an embodiment of the forehead bindi-holding device BH of the invention, the stem element ST comprises a transparent and/or translucid material to minimize the visual impact of the forehead bindi-holding device BH and to maximize the visual impact of a bindi BI via said forehead bindi-holding device BH.

Typically, the one or more cups CU in the forehead bindi-holding device BH of the invention are configured attachable and/or detachable to and/or from the cups-holder CH via a magnets-, screwing-, fitting- or clipping-mechanism.

According to a possible embodiment of the invention, the forehead bindi-holding device BH comprises two cups CU, one external cup CU1 configured to hold an external bindi BI1 oriented towards the public, and another internal cup CU2 configured to hold an internal bindi BI2 oriented towards the forehead skin of the user US.

Preferably, the forehead bindi-holding device BH can also be configured in such a way that, when the external and internal bindis BI1, BI2 are mounted on their respective cups CU1, CU2, the internal bindi BI2 is majorly engulfed by the external bindi BI1 and remains fundamentally hidden from an observer placed in front of the user US, whilst keeping its orientation towards the forehead skin and/or its direct contact with it.

Typically, the one or more cups CU in the forehead bindi-holding device BH of the invention can be hidden by the bindis BI they support.

According to yet another embodiment of the invention, the cups-holder CH is configured attachable and/or detachable to and/or from the stem element ST via a magnets-, screwing-, fitting- or clipping-mechanism.

Figure 1A:
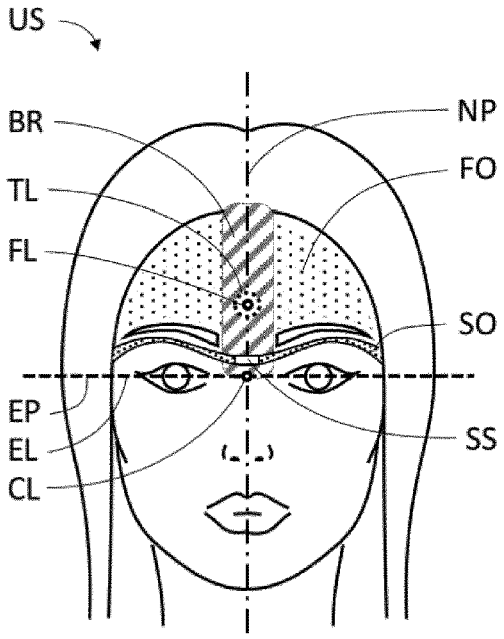
FIG. 1A: Front view of a user's head wearing a supporting object with a supporting segment below the target location for a bindi.

REFERENCES FIGURES code referred as
BH bindi-holding device
US user
FO forehead
EL eyes line
NP nose plane
EP eyes plane
CL Central Line
BI bindis
BI1 external Bindi
BI2 internal bindi
TL target location
BR bindis region
FL forehead line
OL observer's line
SO supporting object
SS supporting segment
SP supporting plane
CU cup
CU1 external cup
CU2 internal cup
BU bindi unit
CH cups holder
CH1 external cups holder
ST stem
SG1-5 stem segment
AU attachment unit
FJ fixed joint
MJ movable joint
PM forehead-pressure mechanism
SR stem rotation
CR cup rotational movement PS pressure on skin
AM adjustment mechanism
OM orientation mechanism
FF folding feature

DETAILED DESCRIPTION OF THE EMBODIMENTS

Prior to describing different embodiments of the invention, the following key concepts are explained: bindis, user, nose plane, eyes line/plane, central line, forehead, target location, forehead line/plane, observer's line, and bindis region.

In some of the subsequent text paragraphs, reference signs are mentioned which appear in the attached drawings.

Bindis

Forehead-worn bindi-like objects (referred as "bindis" or BI or BI1/2) are defined as small marks or elements that some individuals carry on precise horizontally-centered positions of their foreheads, be it in direct or apparent contact with the surface of the forehead skin or at exact distances from it.

Bindis are worn by people for miscellaneous sometimes-mixed purposes such as those of self-beautification, self-bettering, social-identification, and surrounding-environment/people improvement.

Bindis can be considered of two types, depending on the way they are oriented when worn:

- bindis worn oriented to face the exterior of the forehead skin (to the public) and thus openly shown to a common viewer looking from the front (bindi referred as "external bindi" or BI1),
- bindis worn oriented towards the interior of the forehead skin and thus not necessarily shown to a common viewer looking at them from the front (bindi referred as "internal bindi" or BI2).

Bindis are not claimed as part of the device object of this invention.

User, Nose Plane, Eyes Line/Plane, Central Line, Forehead

A common individual using the bindi-holding device is referred as a "user" or US. When wearing the apparatus on his/her head, the user is presumed to be standing up and looking to the front, with his/her head straight and aligned with his/her upper body (as in FIGS. 1A/1B).

The imaginary vertical plane that approximately crosses between a user's eyes splitting the head in two approximately-symmetrical left and right halves, is referred as the "nose plane" or NP. The imaginary horizontal line joining both of the user's eyes is referred as the "eyes line" or EL. The imaginary horizontal plane containing the eyes line is referred as the "eyes plane" or EP. The imaginary line resulting from the intersection between the nose plane and the eyes plane is referred as the "central line" or CL. The external surface of the skin of the user's forehead is referred as "forehead" or FO.

Target Location, Forehead Line/Plane, Observer's Line and Bindis Region

The user requires at least one bindi to be placed at a precise location relative to the specific physiognomy of his/her eyes, nose and forehead (referred as "target location").

The imaginary line that is contained within the nose plane, is approximately perpendicular to the forehead, and crosses a target location, is referred as "forehead line" or FL. The imaginary plane that is perpendicular to the forehead line and contains a portion of the forehead skin is referred as "forehead plane" or FP.

The forehead plane is different for each user as it depends on the specific physiognomy of the user's eyes, nose and forehead, as well as on his/her desired target locations for bindis. The inclination of the forehead plane (which usually varies between 0 and 45 degrees from the vertical) is especially important for determining the optimal orientation of an internal bindi. By way of example, a forehead plane of an average female user wearing bindis at an average position can be estimated to be inclined backwards approximately between 5° and 30° away from the vertical.

It is referred as "observer's line" or OL the imaginary line that:

- is placed within the vertical plane,
- contains the target location for an external bindi,
- and contains the imaginary eye of a perceived common average front desired observer of the said worn external bindi.

The inclination of the observer's line is different for each user as it depends on his/her perceived difference between the vertical height of a worn external bindi and the height of the eyes of targeted potential viewers of the worn bindi. By way of example, a lower-than-average sized individual, may aim for a 75°-from-vertical observer's line because he/she believes most people looking at his/her external bindi from an average proximity when on a standard standing conversation, will be looking down at his/her bindi following a sight line with 25° of descending inclination.

Target locations are within or near the approximate central vertical frame of the user's forehead. More precisely, target locations are considered to be always within a volumetric region (referred as "bindis region" or BR) defined by the set of points:

- that are within parallel planes 1 cm left and 1 cm right from the nose plane,
- that are at a vertical distance between nil and 8 cm above the eyes plane,
- and that are at a horizontal distance between nil and 3 cm measured perpendicularly from the skin of the forehead surface.

Bindi-Holding Device

The solution involves a forehead bindi-holding device (referred as BH) conceived to facilitate, improve and enrichen the experience of wearing bindis.

Key Components

In a first embodiment, the bindi-holding device of the invention comprises:

- one or more elements (referred as "cup" or CU or CU1/2) to support, hold and contain one or more bindis, each element supporting, holding and containing one bindi,
- one cups-holding component (referred as "cups holder" or CH) to fixedly support the one or more cups,
- one elongated-shape element (referred as "stem" or ST or ST1/2) to fixedly support the cups holder at the upper end of the stem,
- one component (referred as "attachment unit" or AU) to facilitate fixed or articulated attachment of the lower end of the stem to a solid supporting segment of a supporting object, the "supporting object" or SO, being worn by the user on his/her head and having the function of supporting the bindi-holding device.

Cups, Bindi Units

Each bindi is associated to one cup, and the function of each cup is to support, contain and hold an associated bindi. A set comprising a cup and its associated bindi is referred as a "bindi unit" or BU1/2.

The cup is a small solid piece, usually with a hollow side, to facilitate supporting/containment/holding of the associated bindi; however, it may also be a simple component with not a hollow space but with a flat or a convex shape such as a small plate or a small protruding shape to which the associated bindi is fixedly attached.

The cup can vary in size and shape depending on the characteristics of the bindi it is to support.

In a preferred embodiment of the invention, the cups are easily attachable/detachable to/from the cups holder via a magnets-, screwing-, fitting- or clipping-mechanism. This mechanism permits bindis fixedly attached to their cups (forming solid bindi units) to be attached/detached to/from the bindi-holding device with ease, thus allowing bindi units to be easily exchangeable.

In a further preferred embodiment of the invention, the cups are two in number: one configured to hold an external bindi (oriented towards the public and referred as "external cup" or CU1) and another one configured to hold an internal bindi (oriented towards the forehead skin and referred as "internal cup" or CU2).

In a still further preferred embodiment of the invention, the two cups are oriented in opposite directions, this is, one configured to hold an external bindi (oriented towards the public) and one configured to hold an internal bindi (oriented towards the forehead skin).

In a further possible embodiment of the invention, one or more of the cups are hidden by the bindis they support. This results in bindi units that, when attached to the cups holder, completely hide the cups to an external viewer.

In a still further possible embodiment of the invention, when the internal bindi and the external bindi are mounted on the bindi-holding device, the internal bindi is engulfed by the external bindi and remains fundamentally hidden from an observer placed in front of the user, whilst keeping its orientation towards the forehead and/or maintaining its direct contact with it.

Cups Holder

The cups holder has the function of supporting one or several of the cups of the bindi-holding device.

In a preferred embodiment of the invention, the cups holder allows easy attachment and detachment of the bindi units.

In a still further preferred embodiment of the invention, the cups holder is inexistent, imperceptible, or hidden by the cups and/or the bindis it supports.

When a cups holder is configured to support an external cup and an internal cup (or, equivalently, an external bindi unit and an internal bindi unit), it is configured to allow placement of the two cups with their bindi placing sides facing opposite directions: one towards the outside of the forehead and one towards the inside of the forehead.

In an alternative embodiment of the invention, the cups holder is easily attachable/detachable to/from the stem via a magnets-, screwing-, fitting- or clipping-mechanism. This allows a pair of bindi units to be easily attached/detached to/from the bindi-holding device not one by one, but both simultaneously.

When adequately worn, the cups holder is approximately placed within the nose plane.

Stem

The stem is an elongated-shape element presenting a longitudinal length that ranges from 1 mm to 4 cm.

The principal functions of the stem comprise:

- fixedly support the cups holder at its upper end,
- be attached to the supporting object via the attachment unit,
- provide sufficient firm reach from the supporting object to the target location,
- and directly or indirectly facilitate precise adjustment of the bindi-holding device in order to place bindis at their target locations.

When adequately worn, the stem is approximately placed within the nose plane.

In a preferred embodiment of the invention, the stem further comprises 5 consecutive segments (referred as "stem segments"):

- a 1st segment with a longitudinal straight shape (referred as "stem segment 1" or SG1),
- a $2^{nd}$ segment with a longitudinal curved shape (referred as "stem segment 2" or SG2),
- a 3rd segment with a longitudinal straight shape (referred as "stem segment 3" or SG3),
- a $4^{th}$ segment with a longitudinal curved shape (referred as "stem segment 4" or SG4),
- and a $5^{th}$ segment with a longitudinal straight shape (referred as "stem segment 5 or SG5").

Stem segments are configured as follows:

- stem segment 1 is attached at its lower end to the attachment unit and it is fixedly attached at its upper end to stem segment 2,
- stem segment 2 is fixedly attached at its lower end to stem segment 1 and at its upper end to straight segment 3,
- stem segment 3 is fixedly attached at its lower end to stem segment 2 and at its upper end to stem segment 4,
- stem segment 4 is fixedly attached at its lower end to stem segment 3 and at its upper end to stem segment 5,
- and stem segment 5 is fixedly attached at its lower end to stem segment 4 and it is attached at its upper end to the cups holder.

Longitudinal lengths of stem segments range from 0 cm to 2 cm, and at least one of them is greater than 1 mm.

Any stem segment presenting a longitudinal length of 0 cm is considered as physically-inexistent but virtually existent, hence non-consecutive physically-existing stem segments are physically attached to one another when all of in-between stem segments are physically-inexistent.

Curvature profiles of stem segment 2 and stem segment 4, if physically-existent, are the former of concave nature and the latter of convex nature or, vice versa, the former of convex nature and the latter of concave nature.

If the attachment unit includes a fixed joint, the stem, or at least one of the stem segments, is made out of a material sufficiently malleable to allow the stem to be bent within the nose plane in order to modify the inclination of the stem relative to the supporting object and/or the position or orientation of the upper end of the stem relative to the supporting object.

The stem can be composed by a transparent or translucid material to minimize visual impact of the bindi-holding device and maximize visual impact of a worn bindi via said bindi-holding device by possibly providing the apparent look of an air-floating bindi.

Supporting Object

The supporting object is an object worn by the user on his/her head such as an eyewear, a diadem-like object, or a specific supporting component created for the bindi-holding device. The fundamental function of the supporting object, relative to the bindi-holding device, is to solidly support said bindi-holding device.

The supporting object can in turn be supported by miscellaneous parts of the user's head, or combinations of them, such as the upper portion of the head, the sides of the head, the forehead, the upper portion of the ears, the upper portion of the nose, or the bridge or lateral sides of the nose.

The supporting object comprises a solid portion (referred as "supporting segment" or SS) that is located approximately within the nose plane and not further than 4 cm away from the bindis region. For a proper usage of the bindi-holding device, the supporting segment must be stable relative to the user's head.

When the supporting object is an eyewear, the supporting segment is usually placed approximately on the central line, below the target location, and touching or almost-touching the skin of the user's nose bridge.

When the supporting object is a diadem-like object, the supporting segment is usually placed on the upper portion of the user's forehead, above the target location, touching or almost-touching its skin.

The imaginary plane parallel to the eyes line, approximately containing the supporting segment, and including the longest dimension within a section of the supporting segment when intersected by the nose plane, is referred as the "supporting plane" or SP.

The supporting object is not claimed as part of this invention.

Attachment Unit

The key function of the attachment unit is to facilitate an attachment arrangement between a lower end of the stem and the supporting segment.

In a possible embodiment of the invention, the attachment between the stem and the supporting segment is of fixed nature (referred as "fixed joint" of FJ), thus not leaving any degree of movement between the lower portion of the stem and the supporting segment. In this case, the attachment unit can be as simple and minimal as a welding, gluing, clipping or screwing arrangement.

In a preferred embodiment of the invention, the attachment between the stem and the supporting segment is articulated comprising a movable joint (referred as MJ) to allow a degree of rotational movement (referred as "stem rotation" or SR) of the stem about its point of union with the supporting object and approximately within the nose plane.

Forehead-Pressure Mechanism

In a further preferred embodiment of the invention, the attachment unit further comprises a mechanism (referred as "forehead-pressure mechanism" or PM) that, based on the elasticity properties of one or more stem segments coupled with the specific configuration of the orientation of the stem relative to the supporting object, and/or based on components such as springs, elastic-bands/plates or any other elements with elastic properties, allows exertion of a mild constant force (referred as "pressure on skin" or PS) directly or indirectly pushing the top end of the stem towards the user's forehead skin and approximately within the nose plane to assure that either an internal bindi, or the back of the cup of an external bindi (via a possible pad-like element), or the cups holder (also via a possible pad-like element), is kept in constant contact with the skin of the user's forehead. Therefore, in some embodiments, the forehead-pressure mechanism (PM) may comprise one or more elastic stem segments orientable disposed in relation to the supporting object and/or comprise a further elastic element or component (i.e. a spring like mechanism or an elastic-band/plate).

The purpose of the forehead-pressure mechanism can be not only to assure constant contact of a bindi with the forehead, but also to provide an additional point of support to the supporting of the supporting object on the head of the user (e.g. when the supporting object is an eyewear, a forehead-pressure mechanism may significantly alleviate the pressure of the weight of the eyewear on the points of contact of the nose pads of the eyewear with the skin of the nose).

In improved embodiments, the supporting object is adapted to integrate the forehead-pressure mechanism with the aim of optimizing volume, manageability and ease of use of the supporting object plus the bindi-holding device.

Adjustment Mechanism

In an alternative embodiment of the invention, the attachment unit further comprises an adjustment mechanism (referred as "adjustment mechanism" or AM) to allow the user to modify and leave fixed the degree of inclination of the stem relative to the supporting object when moving said stem approximately within the nose plane.

In improved embodiments, the supporting object is adapted to integrate the attachment unit with the forehead-pressure mechanism with the aim of optimizing volume, manageability and ease of use of the supporting object plus the bindi-holding device.

Folding Feature

In a further preferred embodiment of the invention, the attachment unit comprises a movable joint that allows up to 180° of rotation of the stem about the movable joint of the attachment unit and relative to the supporting segment in order to facilitate folding of the bindi-holding device into/with the supporting object.

This folding feature (referred as "folding feature" or FF) allows partially hiding the device within the supporting object and/or allows handling a more compact, robust and manageable set comprising the supporting object plus the bindi-holding device when said bindi-holding device is not in operating mode.

The folding of the bindi-holding device with/into the supporting object may not necessarily imply blocking or reducing other uses of the supporting object, nor forcing the user to take off the supporting object from his/her head.

In improved embodiments, the supporting object is adapted to integrate the attachment unit with the forehead-pressure mechanism and/or the adjustment mechanism with the aim of optimizing volume, manageability and ease of use of the supporting object plus the bindi-holding device, for example by having the supporting segment as close as possible to the target location, hence needing a shorter stem easier to be folded with/into the supporting object.

Orientation Mechanism

In a still further advanced embodiment, the cups holder comprises a mechanism (referred as "orientation mechanism" or OM) to allow adjustment of the angle of orientation, within the nose plane, relative to the stem-attached part of the cups holder, of an external portion of the cups holder (referred as "external cups holder" or CH1) capable of holding an external bindi unit, wherein said external cups holder can rotate in a rotational movement (referred as "cup rotation" or CR) about a hinge-like component (referred as "hinge" or HI) that connects said external cups holder with said cups holder CH.

Figure 1B:
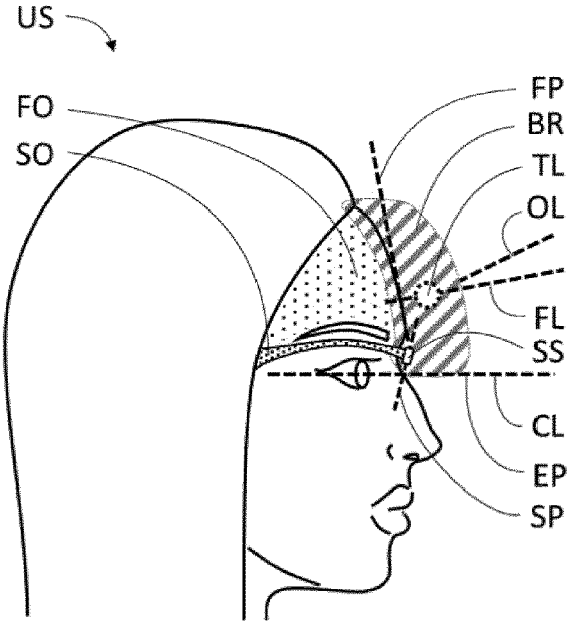
FIG. 1B: Lateral view of FIG. 1A.

Bearing in mind the exposed concepts and functionalities common to the different embodiments of the invention, figures illustrating said embodiments are below described in greater detail:

FIGS. 1A-1B illustrate a front view (FIG. 1A) and a lateral view (FIG. 2A) of the head of a user US wearing a supporting object SO that comprises a supporting segment SS to which a bindi-holding device BH (not shown) can be attached. The supporting segment SS is placed on a supporting plane SP, within the user's nose plane NP, in this case above the user's eyes plane EP and below a possible target location TL for a bindi BI (not shown) that would be placed within the nose plane NP and somewhat separated from the surface of the skin of the user's forehead FO. The target location TL for a bindi is within a volumetric bindi region BR that is enclosed within: two vertical parallel planes at the lateral sides of the nose plane NP, the eyes plane EP, a plane above the eyes plane EP and parallel to it, the surface of the user's forehead FO, and an outer surface parallel to the user's forehead FO. FIGS. 1A-1B also show a central line CL (intersection between nose plane NP and eyes plane EP), a forehead line FL (perpendicular to forehead skin FO intersecting target location TL), a forehead plane FP (perpendicular to forehead line containing a portion of forehead skin FO), and an observer's line OL with an inclination that would depend on the user's desire for a worn external bindi BI1 (not shown) to be seen by the common eye.

Figure 2A:
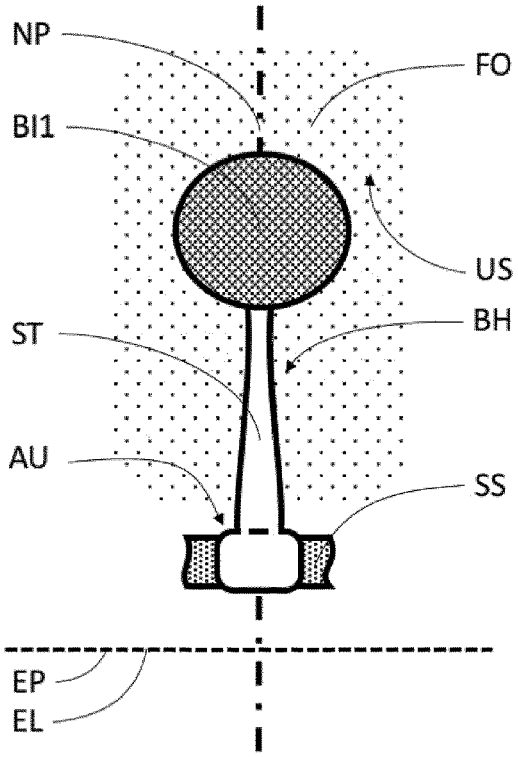
FIG. 2A: Front view of a bindi-holding device with a fixed joint in an attachment unit, holding a non-detachable external bindi, according to the present invention.
Figure 2B:
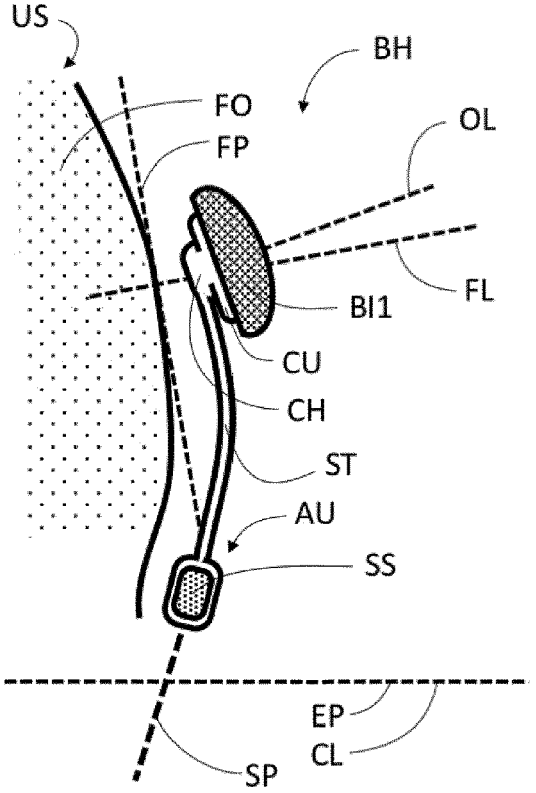
FIG. 2B: Lateral view of FIG. 2A, according to the present invention.

FIGS. 2A-2B show a front view (FIG. 2A) and a lateral view (FIG. 2B) of a preferred embodiment of a bindi-holding device BH worn on the head of a user US, configured for holding one non-detachable external bindi BI1 placed within the user's nose plane NP, above its eyes line EL and eyes plane EP, at a specific distance from the forehead skin FO, and oriented along an observer's line OL. The bindi-holding device uses a stem ST that at its lower end is fixedly attached to a supporting segment SS (shown its section in FIG. 2B) via a fixed-joint attachment unit AU, and at its upper end is fixedly attached to a cups holder CH, wherein said cups holder CH is in turn fixedly attached to a cup CU supporting, holding and containing said external bindi BI1. The specific shape of the stem ST allows optimal attachment with supporting segment SS placed within supporting plane SP having a specific inclination whilst simple and direct reach to the target location and desired orientation for the external bindi BI1. FIGS. 2A-2B also show user's forehead skin FO, central line CL, forehead line FL and forehead plane FP.

Figure 3:
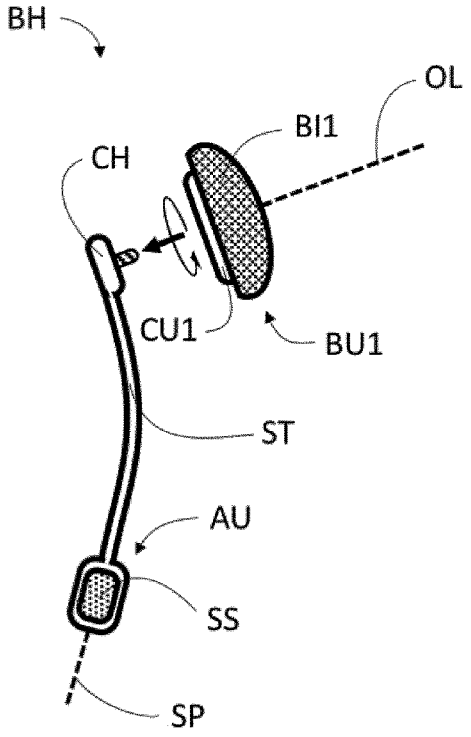
FIG. 3: Lateral view of a detachable external bindi unit using screwing feature to attach it to a cups holder, according to the present invention. The bindi unit is shown unmounted.

FIG. 3 shows a lateral view of a possible embodiment of a bindi-holding device BH, configured to hold one detachable external bindi BI1 oriented along an observer's line OL. In this embodiment, the bindi-holding device uses a stem ST that at its lower end is fixedly attached to a supporting segment SS via a fixed-joint attachment unit AU, and that at its upper end is fixedly attached to a cups holder CH, wherein a screwing feature allows attachment/detachment of external bindi unit BU1 to/from said cups holder CH, and wherein said external bindi unit BU1 is composed by cup CU1 and said external bindi BI1. Supporting segment SS is shown as a section and is oriented along supporting plane SP.

Figure 4:
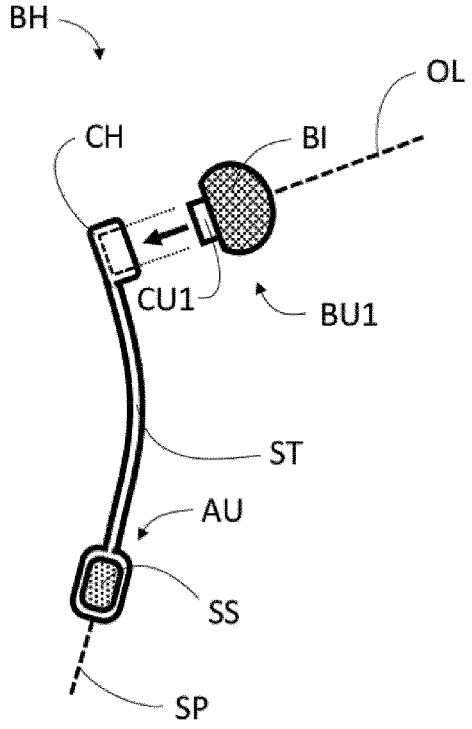
FIG. 4: Lateral view of a detachable external bindi unit using magnets feature to attach it to a cups holder, according to the present invention.

FIG. 4 shows a lateral view of another possible embodiment of a bindi-holding device BH, configured to hold one detachable external bindi BI1 oriented along an observer's line OL. As in FIG. 3, the bindi-holding device uses a stem ST that at its lower end is fixedly attached to a supporting segment SS via a fixed-joint attachment unit AU, and that at its upper end is fixedly attached to a cups holder CH. However, in this embodiment it is a magnets mechanism what allows attachment/detachment of external bindi unit BU1 to/from said cups holder CH. As in FIG. 3, external bindi unit BU1 is composed by cup CU1 and external bindi BI1 and supporting segment SS is shown as a section and is oriented along supporting plane SP.

Figure 5:
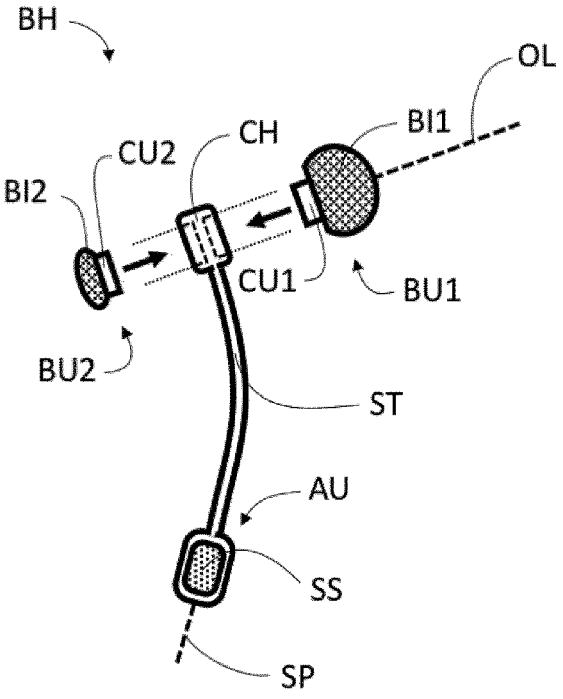
FIG. 5: Lateral view of a bindi-holding device with a fixed joint in the attachment unit, holding one detachable external bindi and one detachable internal bindi, according to the present invention. Both bindis are shown unmounted.

FIG. 5 shows a lateral view of a further embodiment of a bindi-holding device BH, configured to hold not one but two detachable bindis: one external bindi BI1 and one internal bindi BI2. External bindi BI1 and external cup CU1 compose external bindi unit BU1. Internal bindi BI2 and internal cup CU2 compose internal bindi unit BU2. External bindi unit BU1 presents its external bindi BI1 oriented along an observer's line OL and facing up and outwards. Internal bindi unit BU2 presents its internal bindi BI2, oriented in approximate opposition to external bindi BI1 and facing the user's forehead skin FO (not shown). As in FIGS. 3 and 4, stem ST is fixedly attached on its bottom end, via attachment unit AU, to supporting segment SS oriented along supporting plane SP, and is also fixedly attached on its top end to cups holder CH. In this embodiment, cups holder CH presents two hollow spaces at opposed sides capable of perfectly fitting and hosting external cup CU1 and internal cup CU2 via a magnets mechanism.

Figure 6:
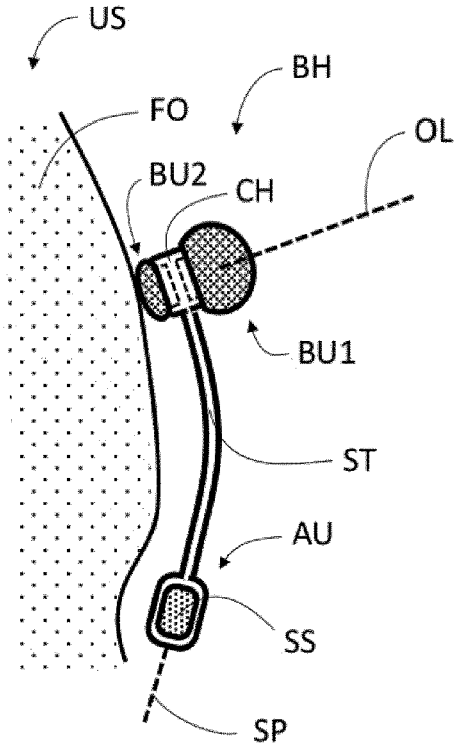
FIG. 6: Lateral view of FIG. 5, but with both bindi units shown mounted and with the internal bindi touching the forehead of a user, according to the present invention.

FIG. 6 shows a lateral view of same preferred embodiment of FIG. 5 but presenting bindi units BU1 and BU2 mounted into cups holder CH (thus cups CU1 and CU2 are not shown) and presenting internal bindi BI2 in touching contact with the skin of the forehead FO of the user US. Rest of reference signs are partially the same as those used in prior figures.

Figure 7:
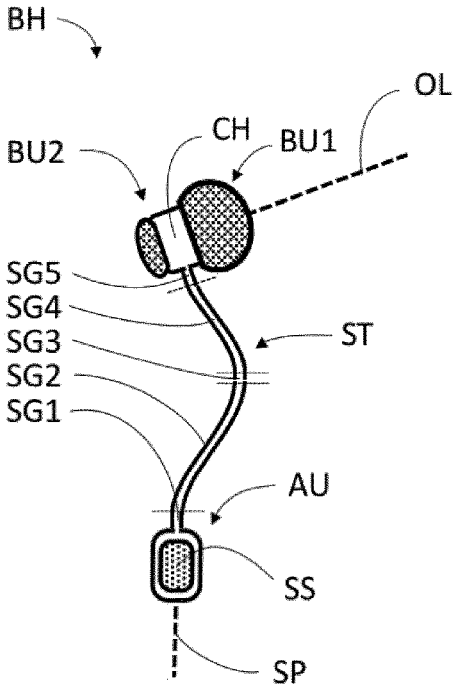
FIG. 7: Lateral view of a bindi-holding device with a fixed joint in the attachment unit, holding one detachable external bindi and one detachable internal bindi, showing a stem presenting a plurality of stem segments, according to the present invention.

FIG. 7 shows a lateral view of a similar embodiment as that of FIG. 6 but presenting a stem ST with a shape composed by 5 possible stem segments SG1-5, wherein straight stem segment SG1 connects attachment unit AU with curved stem segment SG2, which in turn is attached to straight stem segment SG3, which in turn is attached to curved stem segment SG4, which in turn is attached to straight stem segment SG5, which in turn is attached to cups holder CH. In this figure, all stem segments SG1-5 are physically-existent. Rest of reference signs are partially the same as those used in prior figures.

Stems ST can be much simpler than the one shown of FIG. 7. Stem ST of FIG. 6, for example, is composed by only three consecutive physically-existent stem segments SG1-3 (not shown) and two virtual ones SG4-5 (also not shown). In the exemplary embodiment of FIG. 6, physically-existent straight stem segment SG1 is attached at bottom end to attachment unit AU and at top end to physically-existent curved stem segment SG2, in turn attached to physically-existent curved stem segment SG2, in turn attached to physically-existent straight stem segment SG3, in turn attached to physically-inexistent curved stem segment SG4, in turn attached to physically-inexistent straight stem segment SG5, in turn attached to cups holder CH; in other words, as SG4 and SG5 are physically-inexistent, top end of stem segment SG3 is physically attached to cups holder CH.

Figure 8:
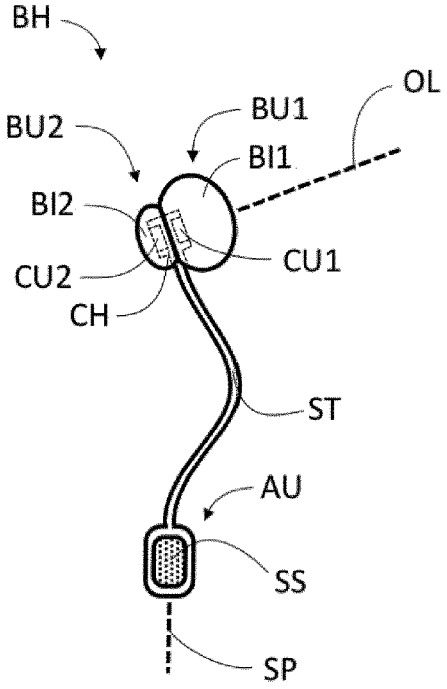
FIG. 8: Lateral view of a bindi-holding device showing an embodiment similar to that of FIG. 7 but with the cups and the cups holder hidden by the bodies of the bindis, according to the present invention.

FIG. 8 shows a lateral view of a similar embodiment as that of FIG. 7, but wherein not only external cup CU1 and internal cup CU2 are hidden within bodies of bindis BI1 and BI2, but also the whole cup holder CH is hidden within said bodies of bindis. Rest of shown reference signs are partially the same as those used in prior figures.

Figure 9:
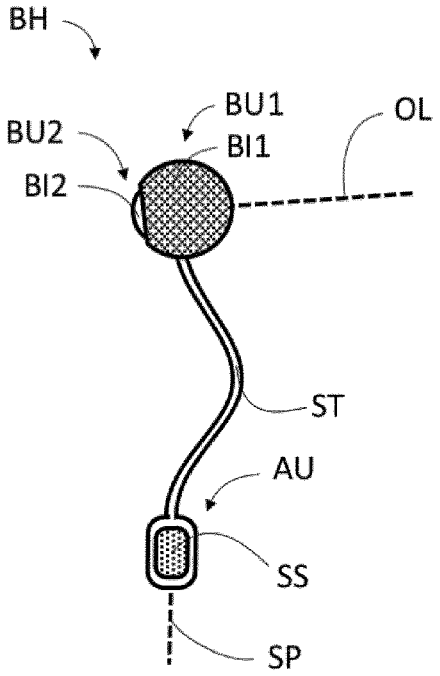
FIG. 9: Lateral view of a bindi-holding device showing an embodiment similar to that of FIG. 8 where the cups holder and the internal bindi are almost totally hidden by the body of the external bindi, according to the present invention.

FIG. 9 shows a lateral view of a further improved embodiment (from that shown on FIG. 8), wherein shape of external bindi BI1 is greater, more spherical and configured to be well seen, whereas internal bindi BI2 is smaller, almost totally engulfed within external bindi BI1, and limited to the purpose of providing close contact with the skin of the forehead FO (not shown). Rest of shown reference signs are partially the same as those used in prior figures.

Figure 10:
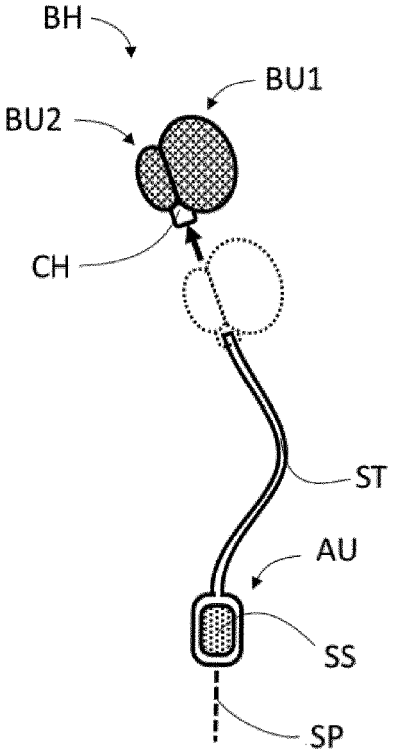
FIG. 10: Lateral view of a bindi-holding device for holding an internal and an external bindi, having a detachable cups holder, according to the present invention.

FIG. 10 shows a lateral view of an alternative embodiment (to the one shown on FIG. 8), wherein cups holder CH is configured to be easily attachable/detachable to/from the stem ST. In the exemplary embodiment of FIG. 6, the cups holder CH presents a cylindrical open shape and is simply inserted/extracted in/from the stem ST via a fitting-mechanism. Other configurations such as magnets-, screwing- or clipping-mechanisms, are of course possible. Rest of shown reference signs are partially the same as those used in prior figures.

Figure 11:
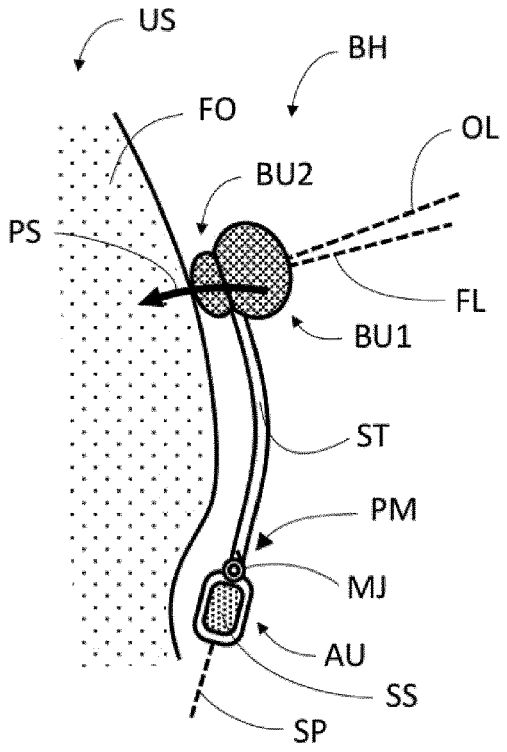
FIG. 11: Lateral view of a bindi-holding device with a movable joint and a forehead-pressure mechanism in an articulated attachment unit, holding one detachable external bindi and one detachable internal bindi, both shown mounted and with hidden cups and cups holder, according to the present invention.

FIG. 11 shows a lateral view of a still further improved embodiment (from that shown on FIG. 8), wherein the attachment unit AU further comprises a movable joint MJ and a forehead-pressure mechanism PM that, thanks to a spring-like mechanism, provides a rotational force to the stem ST, about the movable joint MJ, towards the skin of the forehead FO of the user US, and relative to the supporting segment SS, and wherein said rotational force further creates a pressuring force PS of the skin-touching surface of the internal bindi BI2 into the touched skin of the forehead FO. Rest of shown reference signs are partially the same as those used in prior figures.

Figure 12:
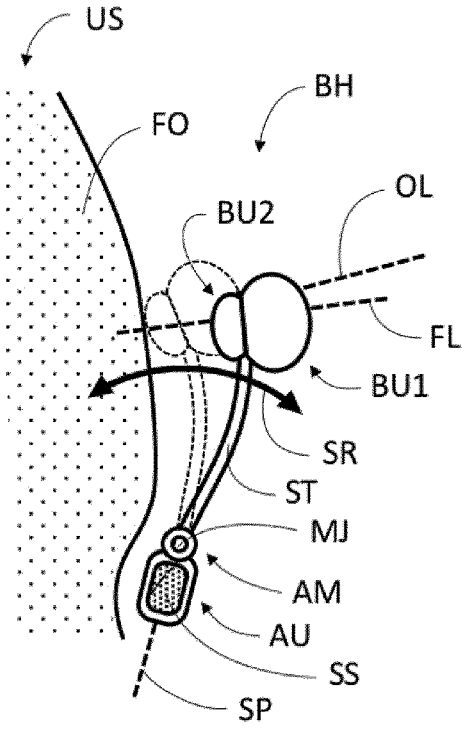
FIG. 12: Lateral view of a bindi-holding device with a movable joint, where the bindi-holding device comprises an adjustment mechanism, according to the present invention.

FIG. 12 shows a lateral view of an alternative embodiment, wherein the attachment unit AU with a movable joint MJ comprises an adjustment mechanism AM that allows the user US to modify and leave fixed the degree of inclination of the stem ST relative to the supporting segment SS of the supporting object SO (not shown) when moving it within the user's nose plane NP (not shown). Rest of shown reference signs are partially the same as those used in prior figures.

Figure 13:
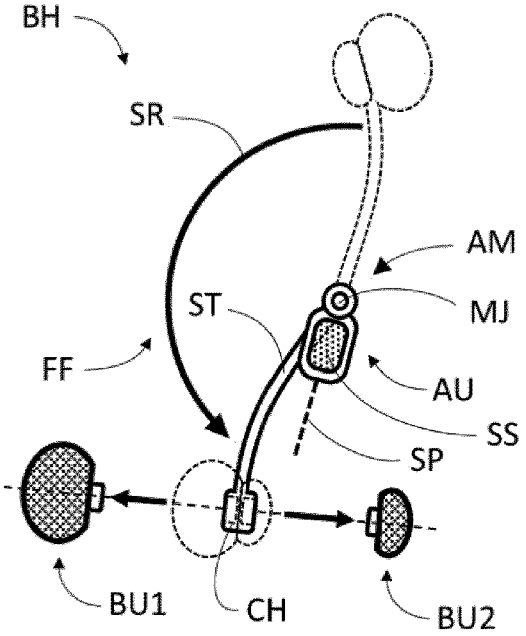
FIG. 13: Lateral view of a bindi-holding device with folding feature, where the bindi units are shown unmounted, according to the present invention.

FIG. 13 shows a lateral view of a further advanced preferred embodiment of a two-bindis (internal/external) holding device BH, further comprising a folding feature FF that allows up to 180° rotation of the stem ST relative to supporting segment SS and about movable joint MJ of attachment unit AU in order to facilitate folding of the bindi-holding device into/with the supporting object SO (not shown). External bindi unit BU1 and internal bindi unit BU2 are shown unmounted from cups holder CH. Rest of shown reference signs are partially the same as those used in prior figures.

Figure 14:
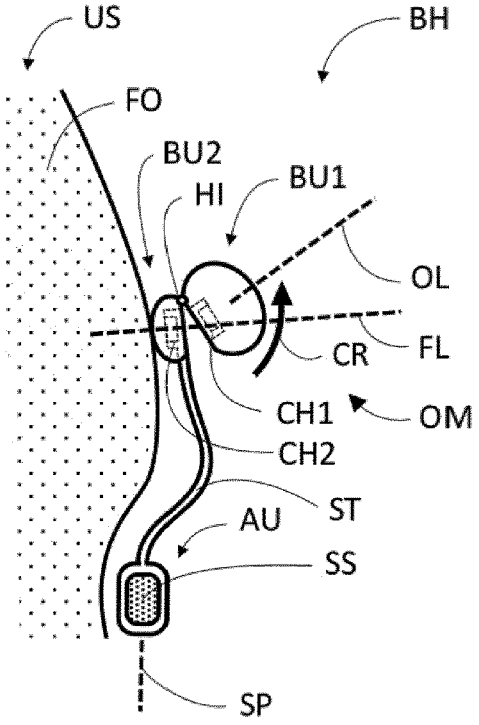
FIG. 14: Lateral view of a bindi-holding device with an orientation mechanism, where the bindi units are shown mounted, according to the present invention.

FIG. 14 shows a lateral view of an alternative embodiment of a two-bindis (internal/external) holding device BH further comprising an orientation mechanism OM to allow adjustment of the angle of orientation, within the nose plane NP (not shown), relative to the cups holder CH, of an external cups holder CH1 capable of holding an external bindi unit BU1, wherein said external portion of the cups holder CH1 can rotate in rotational movement CR about a hinge-like component HI that connects said external portion of the cups holder CH1 with said cups holder CH, in turn attached to stem ST. External bindi unit BU1 and internal bindi unit BU2 are shown respectively mounted on external cups holder CH1 and internal cups holder CH2. Rest of shown reference signs are partially the same as those used in prior figures.

Figure 15:
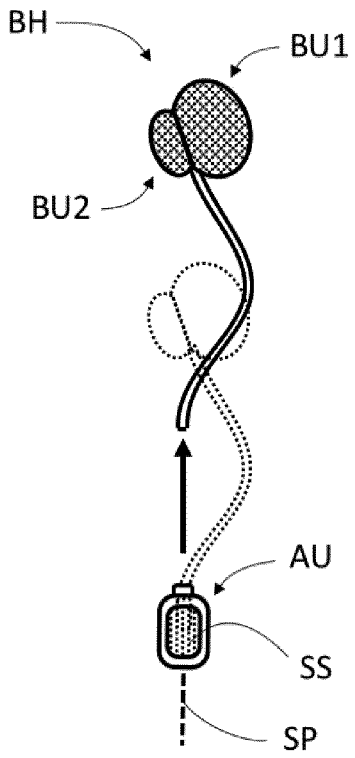
FIG. 15: Lateral view of a bindi-holding device with a stem attachable/detachable to/from the attachment unit, according to the present invention.

FIG. 15 shows a lateral view of an alternative embodiment of a two-bindis (internal/external) holding device BH, where the stem ST is easily attachable and/or detachable from the attachment unit AU by the user. In the exemplary embodiment of FIG. 15, the attachment unit AU presents a cylindrical open shape that allows simply insertion/extraction from the stem ST via a fitting-mechanism. Other configurations such as magnets-, screwing- or clipping-mechanisms, are of course possible. Rest of shown reference signs are partially the same as those used in prior figures.

USE OF THE BINDI-HOLDING DEVICE

Following, there is a list of explanatory steps on how a preferred embodiment of the bindi-holding device can be used/worn:

1) The user takes the supporting object, e.g. a piece of eyewear, to which the bindi-holding device has been previously, temporarily or permanently, attached.

2) If the bindi-holding device is configured to hold an external bindi, the user may compose his/her own external bindi by choosing and placing its material(s) inside the cup of the bindi-holding device meant to hold the external bindi, or he/she may choose a bindi unit from a possible set of existing exchangeable external bindi units to later attach it to a corresponding part of the cups holder devised for holding the external bindi. As way of example, an external bindi material could be a nicely-odorous sandal-wood paste, or an external bindi unit could be a precious jewel fixedly mounted into a cup specifically designed to be attached to the bindi-holding device.

3) If the bindi-holding device is configured to hold an internal bindi, the user may compose his/her own internal bindi by choosing and placing its material(s) inside the cup of the bindi-holding device meant to hold the internal bindi, or he/she may choose one bindi unit from a set of possible exchangeable internal bindi units to later attach it to a corresponding part of the cups holder devised for holding the internal bindi. As way of example, an internal bindi material could be a mix-of-herbs medicinal powder or an iodine-supplement healing patch, or an internal bindi unit could be a bio-magnetic healing stone fixedly mounted to a cup specifically designed to be attached to the bindi-holding device.

4) The user puts the supporting object on his/her head (e.g. supporting it on the top portion of his/her ears and/or on the laterals of his/her nose bridge) assuring it is sufficiently stable. If the bindi-holding device comprises a folding feature, the user unfolds the bindi-holding device from the supporting object in order to properly put it on his/her forehead (in its operating position).

5) If the bindi-holding device has been already configured to the specific needs and wants of the user, the user can proceed to wear the bindi-holding device and enjoy the bindi-wearing experience until he/she wants to take off or annulate the functioning of the bindi-holding device (step 11).

6) In order to find the target location of a bindi by adjusting the bindi-holding device, the user, consciously or unconsciously, directly or indirectly, is considering the following variables:

- number, type, size, shape, consistency and value of bindis to be worn,
- distance to place the bindis measured perpendicularly away from the forehead,
- distance to place the bindis measured vertically upwards from the central line,
- inclination of the forehead plane towards which an internal bindi is to be oriented,
- orientation of the observer's line along which an external bindi is to be oriented,
- inclination of the support segment, this is, inclination of the supporting plane,
- degree of desired hiding/showing of the bindi-holding device for a common viewer placed in front of the user and/or placed at a side of the user,
- degree of aesthetics and liking of wearing the supporting object plus the bindi-holding device with the chosen bindi units mounted.

7) If the bindi-holding device comprises a forehead-pressure mechanism, and the user wants to wear an internal bindi permanently touching his/her forehead, the user in principle does not need to modify the inclination of the stem relative to the supporting object because the forehead-pressure mechanism assures permanent sufficient contact of the internal bindi with the forehead. Nevertheless, the user may want to modify other variables regarding the shape and positioning of the stem in order to reach the precise target location for the internal bindi.

8) If the attachment unit of the bindi-holding device comprises an adjustment mechanism the user can make use of it to gradually modify the inclination of the stem relative to the supporting object until the bindi(s) attached at the top end of the stem (via their cups and the cups holder) reach target location(s).

9) If the bindi-holding device is composed by a malleable material, and it does not include an adjustment mechanism, or does not include a forehead-pressure mechanism, or if the forehead-pressure mechanism is not enough to place the bindi(s) at its(their) exact desired position(s), the stem can be bent manually in order to reach the aimed target location(s).

10) A short trial-and-error process might be needed to find the optimal configuration of the bindi-holding device in order to reach a permanent perfect user-customized placement for the bindi(s).

11) When wanting to temporarily quit wearing the bindi(s), the user can simply take off from his/her head the supporting object with the bindi-holding device attached. If the bindi-holding device includes a folding feature, the user may want to fold the bindi-holding device into/with the supporting object—and possibly to dismount the bindi unit(s)—and then continue wearing the supporting object with the bindi-holding device in its folded (non-operating) position.

12) In the case of a bindi-holding device with an orientation mechanism, the user may want to use it to modify the inclination of the external bindi relative to the internal bindi or the cups holder by means of simple manual modification of the angle between the external cups holder (holding the cup external cup with the external bindi) and the part of the cups holder attached to the stem.

What is claimed is:

1. A forehead bindi-holding device for holding at least one bindi and configured to be arranged on a supporting object worn by a user, wherein when the user wears the supporting object with the forehead bindi-holding device, the at least one bindi is placed on a desired specific spot of a forehead of the user;

wherein the forehead bindi-holding device comprises:

one or more cups, wherein each of the one or more cups supports, holds and contains each of the at least one bindi;

a cups-holder to support the one or more cups;

a stem element to support the cups-holder at an upper end of the stem element;

an attachment unit for attaching a lower end of the stem element to the supporting object;

and the attachment unit further comprises a forehead pressure-mechanism configured to exert a sufficient constant force to push a top end of the stem element towards the forehead of the user.

2. The forehead bindi-holding device according to claim 1, wherein the stem element comprises a plurality of consecutive segments, the plurality of consecutive segments are of a longitudinal straight shape and/or of a longitudinal curved shape.

3. The forehead bindi-holding device according to claim 2, wherein at least one of the plurality of consecutive segments of the stem element is made out of a material sufficiently malleable to allow the stem element to modify an inclination of the stem element relative to the supporting object and/or a position of the upper end of the stem element relative to the supporting object.

4. The forehead bindi-holding device according to claim 1, wherein the attachment unit is fixed, not leaving any substantial degree of movement between the lower-end of the stem element and the supporting object.

5. The forehead bindi-holding device according to claim 4, wherein the attachment unit further comprises a forehead pressure-mechanism configured to exert a sufficient constant force to push a top end of the stem element towards the forehead of the user.

6. The forehead bindi-holding device according to claim 1, wherein the attachment unit between the stem element and the supporting object is articulated, comprising a movable joint to allow a degree of rotational movement of the stem element about a point of union of the movable joint with the supporting object.

7. The forehead bindi-holding device according to claim 6, wherein the attachment unit further comprises an adjustment mechanism allowing to modify and fix a degree of an inclination of the stem element with respect to the supporting object.

8. The forehead bindi-holding device according to claim 6, wherein the attachment unit allows up to 180° of rotation of the stem element about the movable joint and relative to the supporting object to facilitate folding of the forehead bindi-holding device into/with the supporting object.

9. The forehead bindi-holding device according to claim 6, wherein the attachment unit further comprises a forehead pressure-mechanism configured to exert a sufficient constant force to push a top end of the stem element towards the forehead of the user.

10. The forehead bindi-holding device according to claim 1, wherein the forehead-pressure mechanism comprises one or more elastic stem segments orientable disposed in relation to the supporting object and/or comprises a further elastic element or a component.

11. The forehead bindi-holding device according to claim 1, wherein the stem element comprises a transparent material and/or a translucid material to minimize a visual impact of the forehead bindi-holding device and to maximize a visual impact of the at least one bindi via the forehead bindi-holding device.

12. The forehead bindi-holding device according to claim 1, wherein the one or more cups are configured attachable and/or detachable to or from the cups-holder via magnets, screwing, fitting, or clipping mechanisms.

13. The forehead bindi-holding device according to claim 12, wherein the one or more cups comprises two cups, wherein an external cup of the two cups is configured to hold an external bindi of the at least one bindi oriented towards a public, and an internal cup of the two cups is configured to hold an internal bindi of the at least one bindi oriented towards a forehead skin of the user.

14. The forehead bindi-holding device according to claim 12, wherein the one or more cups are hidden by the at least one bindi supported by the one or more cups; or wherein the cups-holder is hidden by the one or more cups and/or the at least one bindi supported by the cups-holder.

15. The forehead bindi-holding device according to claim 12, wherein the cups-holder is configured attachable and/or detachable to or from the stem element via magnets, screwing, fitting, or clipping mechanisms.

16. The forehead bindi-holding device according to claim 1, wherein the one or more cups are hidden by the at least one bindi supported by the one or more cups; or wherein the cups-holder is hidden by the one or more cups and/or the at least one bindi supported by the cups-holder.

17. A forehead bindi-holding device for holding at least one bindi and configured to be arranged on a supporting object worn by a user, wherein when the user wears the supporting object with the forehead bindi-holding device, the at least one bindi is placed on a desired specific spot of a forehead of the user;

wherein the forehead bindi-holding device comprises:

one or more cups, wherein each of the one or more cups supports, holds and contains each of the at least one bindi:

a cups-holder to support the one or more cups;

a stem element to support the cups-holder at an upper end of the stem element; and an attachment unit for attaching a lower end of the stem element to the supporting object, wherein the one or more cups comprises two cups, wherein an external cup of the two cups is configured to hold an external bindi of the at least one bindi oriented towards a public, and an internal cup of the two cups is, configured to hold an internal bindi of the at least one bindi oriented towards a forehead skin of the user.

18. The forehead bindi-holding device according to claim 17, wherein when the external bindi and the internal bindi are mounted on the external cup and the internal cup respectively, the internal bindi is majorly engulfed by the external bindi and remains fundamentally hidden from an observer placed in front of the user, whilst keeping an orientation of the internal bindi towards the forehead skin and/or a direct contact with the forehead skin.

19. A forehead bindi-holding device for holding at least one bindi and configured to be arranged on a supporting object worn by a user, wherein when the user wears the supporting object with the forehead bindi-holding device, the at least one bindi is placed on a desired specific spot of a forehead of the user;

wherein the forehead bindi-holding device comprises:

one or more cups, wherein each of the one or more cups supports, holds and contains each of the at least one bindi;

a cups-holder to support the one or more cups;

a stem element to support the cups-holder at an upper end of the stem element; and an attachment unit for attaching a lower end of the stem element to the supporting object wherein the cups-holder is configured attachable and/or detachable to or from the stem element via magnets, screwing, fitting, or clipping mechanisms.

* * * * *